US006662946B2

(12) United States Patent
Bakx

(10) Patent No.: US 6,662,946 B2
(45) Date of Patent: Dec. 16, 2003

(54) WRAPAROUND CARTON WITH UPWARDLY EXTENDING SIDE WALLS

(75) Inventor: Martinus C. M. Bakx, Goes (FR)

(73) Assignee: Meadwestvaco Packaging Systems, LLC, Stamford, CT (US)

( * ) Notice: Subject to any disclaimer, the term of this patent is extended or adjusted under 35 U.S.C. 154(b) by 75 days.

(21) Appl. No.: 10/011,531

(22) Filed: Nov. 5, 2001

(65) Prior Publication Data

US 2003/0085144 A1 May 8, 2003

Related U.S. Application Data

(63) Continuation of application No. PCT/US00/12311, filed on May 5, 2000.

(51) Int. Cl.[7] ..... B65D 85/42
(52) U.S. Cl. ..... 206/419; 206/418
(58) Field of Search ..... 206/418–421, 206/476, 486, 487, 490

(56) References Cited

U.S. PATENT DOCUMENTS

| | | | | | |
|---|---|---|---|---|---|
| 1,039,026 | A | * | 9/1912 | Carter | 206/418 |
| 1,464,835 | A | * | 8/1923 | Snyder | 206/418 |
| 2,368,753 | A | | 2/1945 | Elliott et al. | |
| 2,421,748 | A | * | 6/1947 | Fink | 206/418 |
| 2,537,151 | A | * | 1/1951 | Mires | 206/418 |
| 2,946,498 | A | | 7/1960 | Williamson | |
| 3,136,410 | A | | 6/1964 | Sanford | |
| 3,144,131 | A | | 8/1964 | Pitt et al. | |
| 3,355,011 | A | * | 11/1967 | Cilluffo | 206/419 |
| 3,407,921 | A | | 10/1968 | Cilluffo | |
| 3,568,913 | A | * | 3/1971 | Friedenthal | 206/418 |
| 3,692,228 | A | | 9/1972 | Spiegel | |
| 3,921,895 | A | | 11/1975 | Ziche | |
| 4,561,542 | A | | 12/1985 | Przepiora et al. | |

FOREIGN PATENT DOCUMENTS

| | | |
|---|---|---|
| DE | 90 04 290.5 | 6/1990 |
| DE | 92 05 287.8 | 1/1993 |
| DE | 93 04 605.7 | 5/1993 |
| EP | 0 414 326 A1 | 2/1991 |
| GB | 432490 | 7/1935 |
| GB | 731479 | 6/1955 |
| GB | 2 116 947 | 10/1983 |

* cited by examiner

*Primary Examiner*—Luan K. Bui

(57) ABSTRACT

A carton for holding one or more articles, for example light bulbs, includes an article engaging panel having at least one retaining aperture provided in the engaging panel for receiving and retaining at least one article such that one portion of the at least one article protrudes therethrough, a pair of opposed side walls extending upwardly from the engaging panel to shield the one portion and terminating at the respective free upper edges of the side walls to allow access to the one portion, and a cover arrangement for containing the other portion of the at least one article. The side walls extends away from the cover arrangement. The cover arrangement includes a series of hingedly interconnected panels including a pair of opposed terminal panels. The terminal panels of the cover arrangement are connected to the side walls respectively to form a tubular structure for enveloping the other portion of the at least one article.

8 Claims, 3 Drawing Sheets

WRAPAROUND CARTON WITH UPWARDLY EXTENDING SIDE WALLS

This is a continuation of international application No. PCT/US00/12311, filed May 5, 2000, which is hereby incorporated by reference.

BACKGROUND OF THE INVENTION

This invention relates to a carton which is used for accommodating one or more articles for example light bulbs. More particularly, the invention relates to a wraparound carton of the base gripping type which attaches to the bottom of one or more articles thereby to secure the articles in an array.

It is known to provide light bulb cartons in the form of a tube with apertures for receiving the light bulb fittings. It is also known to provide a cover to protect the upper portion of bulbs to some degree.

U.S. Pat. No. 2,946,498 discloses a light bulb carton comprising a tube which includes apertures for receiving the lamp fittings. A series of panels form the cover for the bulbs. Both the tube and the cover are rectangular in cross section, with the cover having apertures for retaining the upper portion of each.

U.S. Pat. No. 3,144,131 discloses a wraparound package of superficially similar shape to the present invention, but it does not permit easy access to the bulb fittings, and at the same time does not provide a high level protection to the base.

A problem with cartons of this type is that they are generally rectangular in cross section, and therefore require an excessive amount of paperboard when manufactured, and an excessive amount of space when stored. A further problem is that access to the fittings of the bulbs is generally blocked, and therefore the bulbs can not be tested without them first being removed from the carton.

SUMMARY OF THE INVENTION

The present invention seeks to overcome, or at least mitigate the problems of the prior art.

A first aspect of the invention provides a carton for holding one or more articles, for example light bulbs. The carton comprises an article-engaging panel and at least one retaining aperture provided therein for receiving and retaining at least one article such that a portion of the article protrudes therethrough. A tubular cover arrangement is connected to the article engaging panel for containing a portion of the or each article. First and second side walls extend upwardly from the article engaging panel so as to shield the protruding portion whilst allowing access to it.

Preferably, the article engaging panel may have a first tab defining at least part of the aperture, hingedly connected thereto, the tab being displaceable out of the plane of the receiving panel to operatively engage a part of the article when the article is in the aperture.

More preferably, the article engaging panel may have a first fold line extending longitudinally between opposed end edges and interrupted by the tab wherein the tab is hinged to the article engaging panel by second and third spaced fold lines extending mutually divergently from an intersection with the first fold line such that the displacement of the tab out of the plane causes the main panel to be folded about the first fold line.

According to an optional feature of this aspect of the invention the carton may accommodate a plurality of articles and transverse cut lines are provided intermediate each article so as to allow the removal of individual articles.

According to another optional feature of this aspect of the invention the cover arrangement may comprise a plurality of hingedly interconnected panels arranged so as to conform substantially to the shape of the article.

According to a further optional feature of this aspect of the invention the first and second side wall panels may be adapted to pivot about hinged connections to the article engaging panel thereby to cause the uppermost edges of the side panels to move away from each other upon introduction of a users hand to improve access to the protruding portion.

According to a still further optional feature of this aspect of the invention the carton may be for holding one or more light bulbs, and wherein the first and second side walls are adapted to allow access to the light bulb for testing the operation of that light bulb.

A second aspect of the invention provides a blank for forming a carton for accommodating at least one article, for example a light bulb, the blank comprising a plurality of panels foldably connected together in series including a first side panel, an article engaging panel, a second side panel, and a tube forming panel for forming a tubular cover arrangement wherein the article engaging panel is provided with at least one aperture for receiving an article.

Preferably, the article engaging panel may have a first tab defining at least part of the aperture, hingedly connected thereto, the tab being displaceable out of the plane of the receiving panel to operatively engage a part of the article when the article is in the aperture.

More preferably, the article engaging panel may have a first fold line extending longitudinally between the opposed end edges and interrupted by the tab, wherein the tab is hinged to the article engaging panel by second and third spaced fold lines extending mutually divergently from an intersection with the first fold line such that the displacement of the tab out of the plane causes the main panel to be folded about the first fold line.

According to an optional feature of the second aspect of the invention there may further comprise a plurality of transverse cut lines provided intermediate the opposing side edges of the tube forming panel.

According to another optional feature of the second aspect of the invention the cover arrangement may comprise a plurality of hingedly interconnected panels arranged so that in use they conform substantially to the shape of the article.

BRIEF DESCRIPTION OF THE DRAWINGS

Exemplary embodiments are now provided, by the example only, with reference to the accompanying drawings in which.

DETAILED DESCRIPTION OF THE PREFERRED EMBODIMENTS

Figure 1:
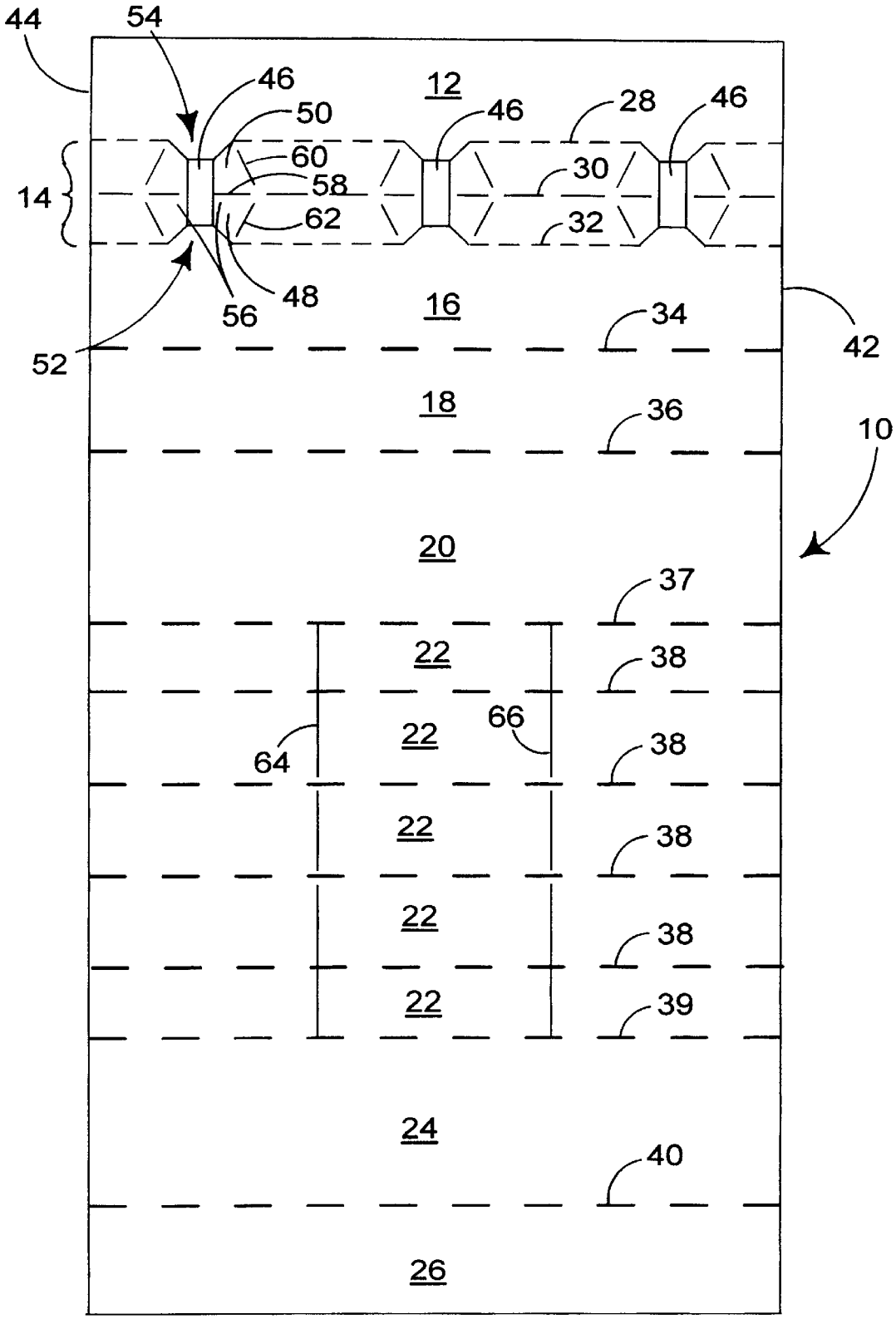
FIG. 1 is a plan view of a blank according to an embodiment of the present invention.

Referring to FIG. 1, there is shown a blank 10 for forming a carton made from paperboard or similar foldable sheet material. In other embodiments there may comprise a two part blank. The blank 10 comprises a series of panels foldably connected one to next in series. Thus, the blank 10 comprises panels for forming article engaging means which in this embodiment comprises an inner side wall panel 12, an article engaging panel 14, a second inner side wall panel 16 hingedly connected one to the next by fold lines 28 and 32. The outer wall is provided by an outer side wall panel 18, panels 20, 22 and 24 for providing a cover arrangement and an outer side panel 26 hingedly connected together in series along fold lines 34, 36, 37, 38, 39 and 40 respectively.

In this embodiment, the side walls are a two ply structure formed from inner and outer side wall panels, although it is envisaged that in some embodiments, a single ply structure can be formed for example by taking out panels 18 and 26.

As mentioned above, a cover arrangement is provided for the articles. In this embodiment, the cover arrangement is formed from panels 20, 22, 24 hingedly connected in series along fold lines 36, 37, 38 and 39 respectively so that in use a tubular structure is formed. A plurality of panels 22 may be hingedly interconnected along a plurality of fold lines 38 in order to wrap around the articles contained within the carton and better conform to the shape of the articles.

Separation means, for example cut lines 64 and 66, may be provided which traverse cover panels 22 substantially perpendicular to fold lines 38 intermediate each article. These may be provided when the carton is intended to hold a plurality of articles, and thus permit a single article to be removed from the carton, whilst allowing the remainder to continue to be secured. In one class of embodiments, the fold lines 37, 39 at which the cut lines 64, 66 terminate may be frangible (not shown) to ease the tearing operation. In an alternative class of embodiments, frangible tear lines may be provided that are co-linear with cut lines 64, 66, thereby enabling individual articles and the corresponding section of the carton to be removed from the main body of the carton.

As illustrated in FIG. 1, article-engaging panel 14 is provided with a plurality of article receiving apertures. In this embodiment, three apertures 46 are provided, although it will be recognised that rather than the carton being formed with a plurality of the receiving apertures, the carton may be formed with only one receiving aperture. Each aperture configuration is substantially the same, therefore only one will be described in further detail. The opposing sides of the aperture carry hinged article gripping tabs 56. Preferably, each gripping tab 56 comprises two panels 48, 50 interconnected along fold line 58. The gripping panels 48, 50 are further connected to the article engaging panel 14 along fold lines 62 and 60 respectively which are preferably divergent. In a set up condition each panel is folded out of alignment to strengthen the tab 56. Receiving panel 14 may further comprise a central interrupted fold line 30 extending between the opposing side edges of the blank 42, 44, and aligned with the gripping tab fold line 58. Fold lines 58, 60, 62 are mutually divergent and intersect along central fold line 30. In a set up condition gripping panels 48, 50 are moved out of the alignment along fold lines 58 and coact with fold line 30 to fold the article-engaging panel 14. In this embodiment each of the hexagonal tab apertures also has two opposingly positioned flaps 52, 54 to assist in retaining the article within the carton.

Figure 2:
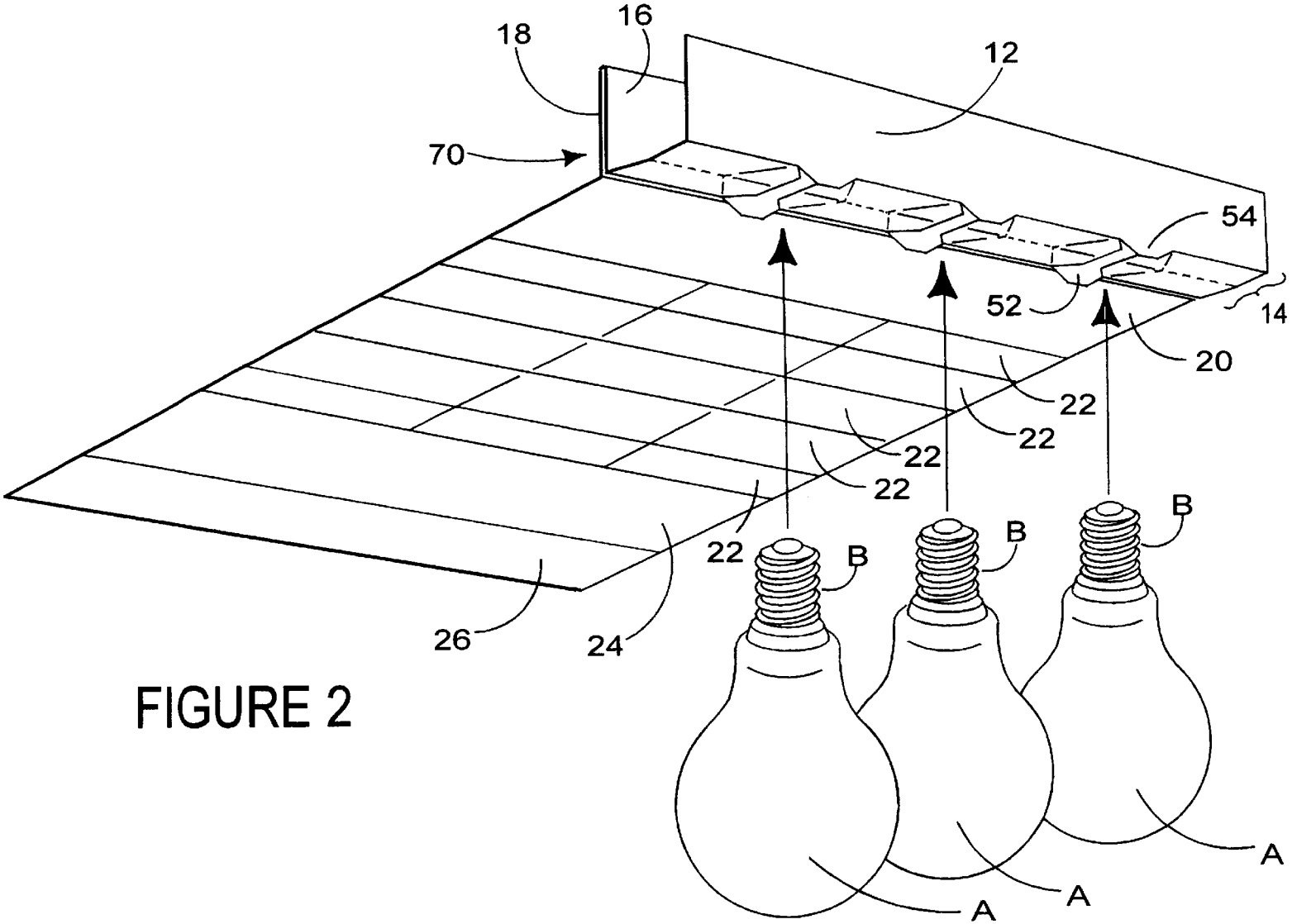
FIG. 2 is a perspective view from below of a partially erected carton formed from the blank of FIG. 1 showing the articles prior to insertion.
Figure 3:
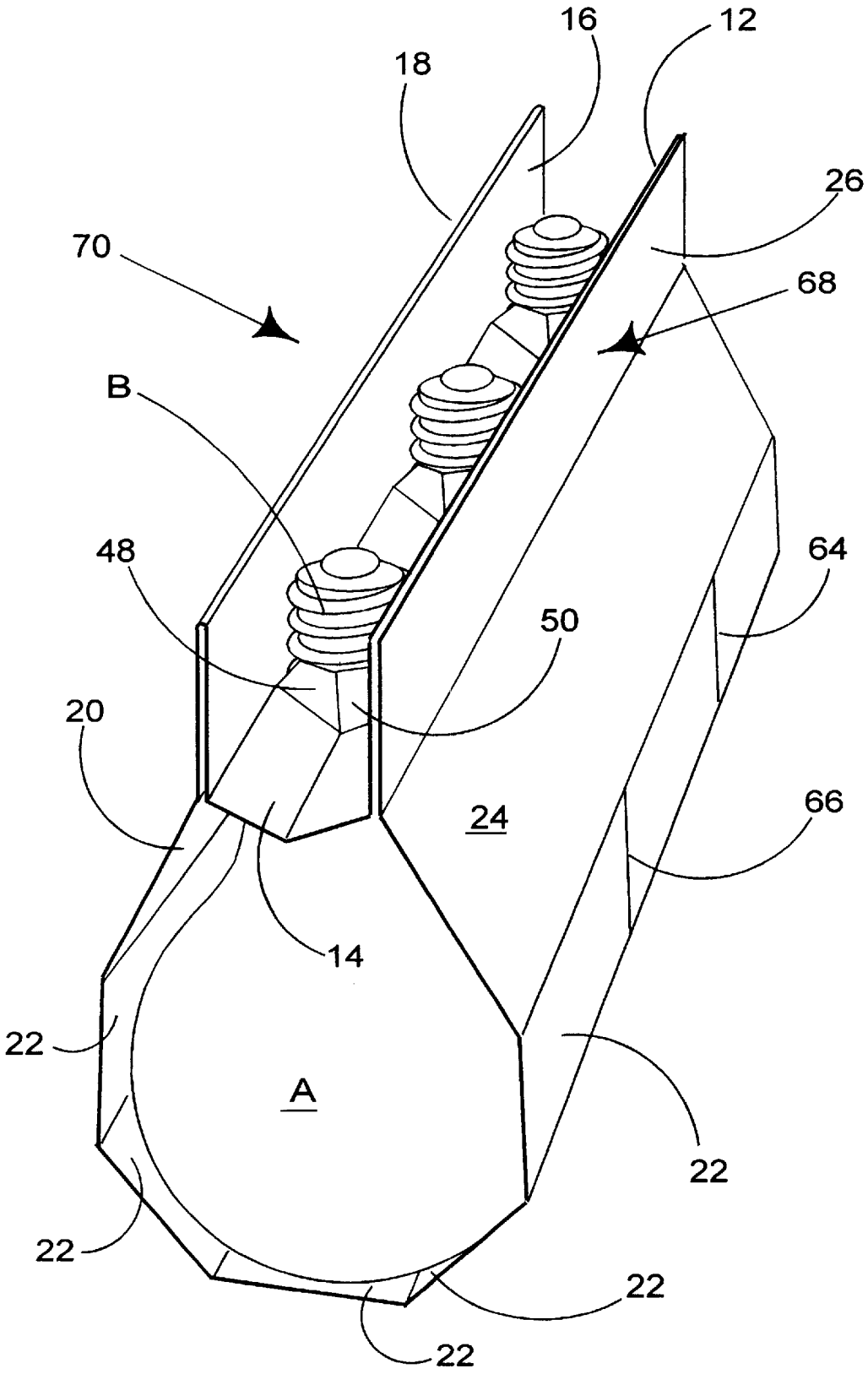
FIG. 3 is a perspective view of the erected carton formed from the blank of FIG. 1 with the articles in place.

Turning to the construction of the carton as illustrated in FIGS. 2 and 3, it is envisaged that the carton of the present invention can be formed by a series of sequential folding and, optionally, gluing operations which can be formed in a straight line machine so that the carton is not required to be rotated or inverted to complete its construction. The folding process is not limited to that described below and can be altered according to particular manufacturing requirements.

Turning now in particular to FIG. 2, inner side wall panels 12 and 16 are folded upwardly such that in this embodiment they are substantially perpendicular to article engaging panel 14. This simultaneously causes flaps 54 and 56, which are non-hinged connected to the first and second side panels 12 and 16 respectively, to be folded downwardly. Subsequently, outer side wall panel 18 is folded to be placed in face contacting relationship with inner side wall panel 16. Glue or other suitable means know in the art may be used to secure the panels together to form a two ply side wall 70. The panels forming the cover arrangement 20, 22, 24 together with the outer side panel 26 are then folded along fold line 36 out of alignment with the side wall 70, shown in FIG. 2 to avoid interfering with the article insertion operation.

Articles A are then inserted through the apertures 46 such that the bases B of the articles protrude through the apertures and are engaged by the gripping tabs 56. It can be seen that when the articles are inserted through the apertures 46, the gripping tabs are forced out of the plane of the receiving panel 14 shown in FIG. 3. As fold lines 58, 60, 62 are mutually divergent from the point of intersection with fold line 30, this causes the receiving panel to fold about fold line 30, such that the apex of the fold points away from the bases B of the articles A, thereby forming a substantially triangular cross section to improve the rigidity of the carton. This has the effect of reducing the amount of paperboard required for the package.

The free edges of the gripping tab 56 grip the bases of the articles, thus preventing their removal without some degree of force. The invention is not intended to be limited to this particular type of "sun-burst" configuration, indeed it is envisaged that other types of known "sun-burst" configurations could be employed in the present invention without departing from its scope.

In this embodiment, the articles A are screw fit light bulbs, the bases being the screw fitting of the bulb. In alternative embodiments the articles may be bayonet fitting bulbs, bottles, vials, or any other article having a suitably shaped base/neck portion which may protrude through the apertures 46. Furthermore, although the carton is shown containing three such articles A, in alternative classes of embodiment, the carton may hold a single article, or virtually any number of articles in a similar longitudinal array.

Once the articles A have been inserted through the apertures, the cover arrangement comprising the plurality of foldably interconnected panels 20, 22, 24 is folded around to encircle the body of the articles thus forming at tubular structure. The number and size of the panels may be adjusted to conform to differently shaped articles. For example, if narrow "candle-type" bulbs are to be accommodated panels 20 and 24 could be increased in size, and the number and/or size of panels 22 reduced.

Once the articles have been encircled, outer side wall panel 26 is secured in face contacting relationship with first side panel 12 using glue or other suitable means known in the art, thus forming the opposing two ply side wall 68.

It can be seen from FIG. 3 that the side walls 68, 70 protect the bases B of the light bulbs from impact damage whilst affording easy access to the fittings. Preferably, the upper edges of side walls are above the protruding portion of the articles. In this embodiment, this allows the light bulbs to be tested without the need for them to be removed from the carton, as the electrical contacts are relatively exposed.

In alternative classes of embodiment, handle means may be provided on the carton, for example, apertures may be provided in the composite side panels 68, 70 by which the carton may be grasped.

It will be recognised that as used herein, directional references such as "top", "base", "end", and "side" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

Furthermore it will be recognised that rather than a side wall being formed from secured panels, the carton blank may be re-arranged whereby some other panel such as a cover panel is formed from the secured together panels.

The present invention and its preferred embodiment relates to an article carrier more particularly a carton for holding light bulbs which is shaped to provide satisfactory rigidity to retain the carton in a set up condition. The shape of the blank minimises the amount of paperboard required for the carton. The items can be applied to the carton by hand or automatic machinery. It is anticipated the invention could be applied to a variety of cartons and not limited to those of the wraparound sort. For example the carton can be adapted to be a top gripping carton whereby the articles are positioned through the article engaging structure, without departing from the scope of invention.

What is claimed is:

1. A carton for holding one or more articles, comprising an article engaging panel having at least one retaining aperture provided therein for receiving and retaining at least one article, a pair of opposed side walls extending upwardly from the engaging panel and terminating at respective free upper edges of the side walls, and a cover arrangement connected to the side walls for containing a portion of the at least one article, the side walls extending away from the cover arrangement, the cover arrangement comprising a series of hingedly interconnected panels including a pair of opposed terminal panels, the terminal panels being connected to the side walls respectively to form a tubular structure for enveloping said portion, wherein the engaging panel has a first tab defining at least part of the aperture, hingedly connected thereto, the first tab being displaceable out of a plane of the engaging panel to operatively engage the at least one article, wherein the engaging panel has a first fold line extending longitudinally between opposed end edges of the engaging panel and interrupted by the first tab, and wherein the first tab is hinged to the engaging panel by second and third spaced fold lines extending mutually divergently from an intersection with the first fold line such that displacement of the first tab out of said plane causes the engaging panel to be folded about the first fold line.

2. A carton for holding one or more articles, comprising an article engaging panel having at least one retaining aperture provided therein for receiving and retaining at least one article, a pair of opposed side walls extending upwardly from the engaging panel and terminating at respective free upper edges of the side walls, and a cover arrangement connected to the side walls for containing a portion of the at least one article, the side walls extending away from the cover arrangement, the cover arrangement comprising a series of hingedly interconnected panels including a pair of opposed terminal panels, the terminal panels being connected to the side walls respectively to form a tubular structure for enveloping said portion, wherein at least one transverse cut line is provided at least in the cover arrangement, the transverse cut line extending transversely of a tubular axis of the tubular structure so as to allow removal of the at least one article individually from the carton.

3. A carton for holding one or more articles, comprising an article engaging panel having at least one retaining aperture provided therein for receiving and retaining at least one article, a pair of opposed side walls extending upwardly from the engaging panel and terminating at respective free upper edges of the side walls, and a cover arrangement connected to the side walls for containing a portion of the at least one article, the side walls extending away from the cover arrangement, the cover arrangement comprising a series of hingedly interconnected panels including a pair of opposed terminal panels located at opposite ends of the series of the hingedly interconnected panels, the terminal panels being connected to the side walls respectively so that the hingedly interconnected panels form an open-ended tubular structure for enveloping said portion, and wherein the side walls are hingedly connected to the terminal panels and to the engaging panel so as to be able to pivot with respect to the cover arrangement and to the engaging panel to cause uppermost edges of the side walls to move away from each other upon introduction of a user's hand to improve access to the at least one article.

4. The carton according to claim 3 wherein the engaging panel has a first tab defining at least part of the aperture, hingedly connected thereto, the first tab being displaceable out of a plane of the engaging panel to operatively engage the at least one article.

5. The carton according to claim 3 wherein the hingedly interconnected panels of the cover arrangement are arranged so as to conform substantially to a shape of the at least one article.

6. The carton according to claim 3 wherein each of said side walls comprises a pair of inner and outer side panels, the inner side panels extending upwardly from the engaging panel, the outer side panels being secured in face contacting relationship to the inner side panels respectively, the terminal panels being connected to lower edges of the outer side panels respectively.

7. The carton according to claim 6 wherein one of the outer side panels is hingedly connected to a respective one of the inner side panels along a respective one of said upper free edges.

8. A carton for holding one or more articles, comprising an article engaging panel having at least one retaining aperture provided therein for receiving and retaining at least one article, a pair of opposed side walls extending upwardly from the engaging panel and terminating at respective free upper edges of the side walls, and a cover arrangement connected to the side walls for containing a portion of the at least one article, the side walls extending away from the cover arrangement, the cover arrangement comprising a series of hingedly interconnected panels including a pair of opposed terminal panels, the terminal panels being connected to the side walls respectively to form a tubular structure for enveloping said portion, wherein each of said side walls comprises a pair of inner and outer side panels, the inner side panels extending upwardly from the engaging panel, the outer side panels being secured in face contacting relationship to the inner side panels respectively, wherein the inner side panels are hingedly connected to the engaging panel, and the outer side panels are hingedly connected respectively to the terminal panels, and wherein each of the inner and outer side panels has a pair of opposed free side edges, whereby the side walls are able to pivot with respect to the cover arrangement and to the engaging panel to cause uppermost edges of the side walls to move away from each other upon introduction of a user's hand to improve access to the at least one article.

* * * * *